US006495236B1

(12) United States Patent
Matthias

(10) Patent No.: US 6,495,236 B1
(45) Date of Patent: Dec. 17, 2002

(54) ARTIFICIAL LAWN WITH HOLLOW GRASS BLADES

(75) Inventor: Claus Matthias, Taunusstein (DE)

(73) Assignee: Ten Cate Nicolon B.V., Nijverdal (NL)

( * ) Notice: Subject to any disclaimer, the term of this patent is extended or adjusted under 35 U.S.C. 154(b) by 0 days.

(21) Appl. No.: 09/674,520

(22) PCT Filed: May 12, 1999

(86) PCT No.: PCT/EP99/03276

§ 371 (c)(1),
(2), (4) Date: Jan. 22, 2001

(87) PCT Pub. No.: WO99/60213

PCT Pub. Date: Nov. 25, 1999

(30) Foreign Application Priority Data

May 20, 1998 (DE) ..... 198 22 542

(51) Int. Cl.[7] ..... B32B 1/08

(52) U.S. Cl. ..... 428/98; 428/36.9; 273/DIG. 13

(58) Field of Search ..... 428/17, 36.9; 273/DIG. 13

(56) References Cited

U.S. PATENT DOCUMENTS 5,601,886 A 2/1997 Ishikawa et al. ..... 428/17

FOREIGN PATENT DOCUMENTS

| | | |
|---|---|---|
| FR | 2333534 | 7/1977 |
| GB | 1381301 | 1/1975 |

*Primary Examiner*—Alexander S. Thomas
(74) *Attorney, Agent, or Firm*—Jacobson Holman PLLC

(57) ABSTRACT

An artificial lawn able to absorb and store quantities of water. The stored water is released only when the lawn is walked upon and is available to improve its sliding properties. The artificial lawn includes blades which are at least partly hollow and can consist of small U-shaped tubes. The small tubes can further have openings in their lateral wall so as possibly to be able to absorb water also from the support layer or from a water-storing layer.

7 Claims, 1 Drawing Sheet

ARTIFICIAL LAWN WITH HOLLOW GRASS BLADES

DESCRIPTION

Figure 1:
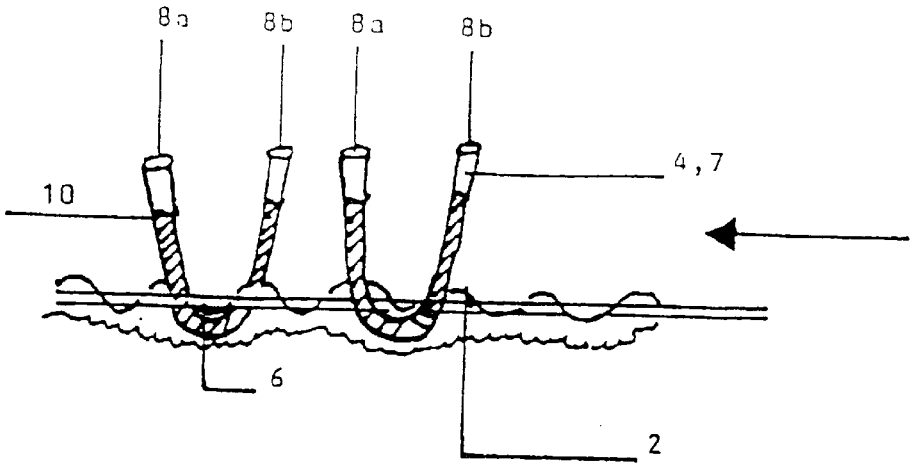

The invention relates to an artificial lawn with at least partly hollow plastic blades, which are attached to a support layer.

Artificial lawns are provided with blades, consisting of filaments of different thickness and length, which are attached to a support layer. In most cases the support layer is a plastic wire netting in which the wire filaments are embedded. Normally the wire filaments are processed by means of tufting, knitting or another mechanical method, so that a grass turf is created. The material of the blades is mostly polypropylene (PP), polyamide (PA), polystyrene (PS) or Polyethylene (PE), whereby these plastics are coloured green or the like. The wire or grass filaments can also be bundled into a bundle and as such fastened in the support layer. The structure of the blades can be smooth, curled or corrugated, making it suitable for each application. The grass filaments can have different lengths and can be adapted to the application.

Artificial lawns have to be moistened, like natural grass, in order to avoid static charges and excessive heat and also to acquire improved sliding characteristics, thereby reducing the risk of injuries due to a sliding. Moistening results in an improved mini-climate. Moistening can be done using an overground irrigation system or a subterranean irrigation system. Since the storing capacity of the artificial lawns is mainly determined by the affixture of water to the blades and that the affixed water will quickly evaporate due to solar radiation, the water consumption will be very high by warm weather conditions and amounts to about 10 $m^3$ per 6000 $m^2$ artificial lawn surface. 30% to 50% of that amount leaks unused into the ground. Wind and maintenance activities also reduce the amount of affixed water, resulting in a shortage at the time of playing. At higher temperatures moistening has to be performed several times per day.

U.S. Pat. No. 5,601,886 discloses an artificial lawn with blades having curled, or spiral shaped wounded filaments respectively. The water storing capacity is small, due to the partly high density of the windings, and the eventually stored water can leak freely in downward direction. Such blades are unsuitable for storing water.

In an WDE-41 36 341 A1 filament shaped plastic blades are known, which are implanted on a water-storing layer. However the blades themselves are uncapable of storing moisture.

It is an object of the invention to provide an artificial lawn, which is capable of absorbing and storing more water, whereby said stored water can be released only when treaded, thereby improving the sliding characteristics.

This object is obtained by an artificial lawn, whereby said blades are constructed as small tubes.

The blades are capable of storing water from rain, mist, air humidity and moistening devices using capillary forces.

Water stored in said blades is protected against solar radiation and wind and will only be released, wenn the blades are squeezed due to walking. Hollow blades have the advantage, that they can store a much greater amount of water and that water can be released at the time it is required.

Advantageously said hollow tubes have a U-shape and are attached to the support wire netting by means of tufting or knitting, whereby the open legs of the -U- are pointing upwards for storing water.

Usually the ordinary grass-filaments are bundled into a bundle of blades. This method is also applicable to blade tubes, whereby the U-shaped tubes are attached to the wire netting. This means, that air present in each leg of the U-shaped tubes can not escape, when water is entering, thereby hindering the absorbing of water under certain circumstances. It is therefore prefered to provide at least one vent opening in the wall of the tube, perferably directly above the support layer. The opening or openings in the wall of the blades are preferably so small, that the stored water is prevented from leaking through the openings.

The U-shaped tubes can also be attached to the support wire netting, whilst not being pinched off. The U-shaped tubes are then with their lower side glued to the support layer using suitable plastics.

When furthermore, the support layer is provided with a water-storing layer consisting of a membrane or a foam, the openings can be partly or solely located near the support layer or the water-storing layer. The hollow blade is then also capable of absorbing moisture out of the support layer using capillary forces. This is very advantageous in the event that during playing nearly all the water has been squeezed off from the blades, but that there is still some water present in the storing layer. A refilling of the hollow blades can thus take place during playing.

In order to fascilitate the filling of the hollow blades by means of capillary forces a hydrophilic material is preferably used for manufacturing the tubes. A further possibility is the application of a hydrophilic layer to the interior wall of the tubes.

For example the tubes can be manufactured using an extrusion technique.

Specific embodiments of the invention are described below in view of the drawings.

Figure 2:
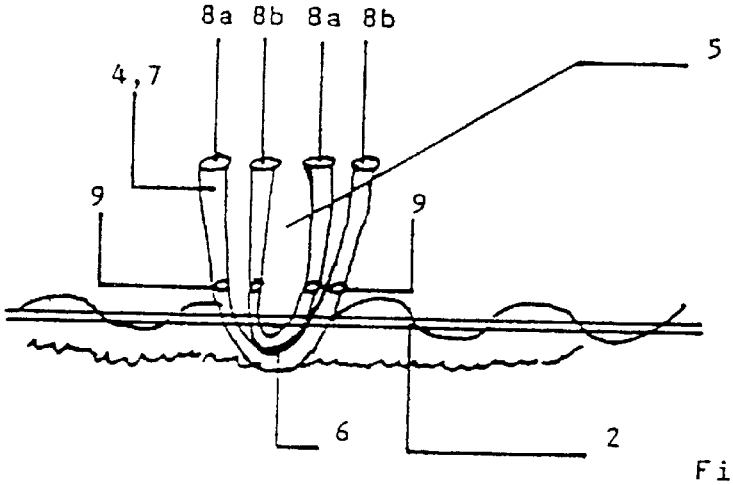
Figure 3:
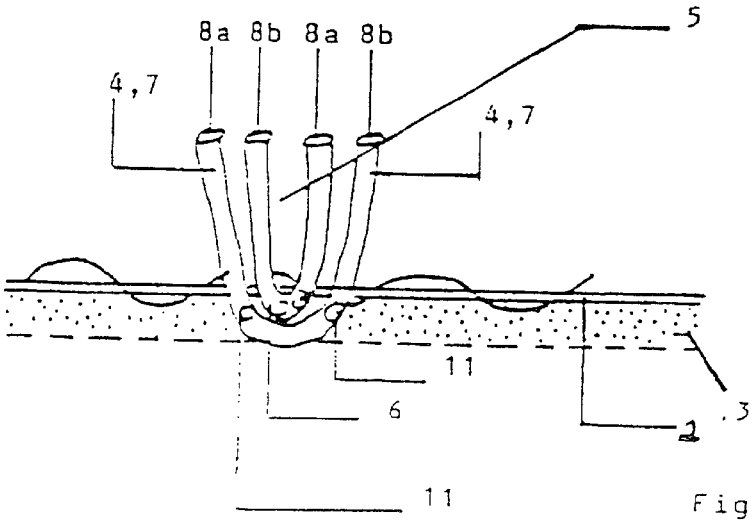

They show in:

FIG. 1 a side view and partly a sectional view of a schematic embodiment of a part of an artificial lawn with blades;

FIG. 2 a side view of a bundle of blades according to another embodiment; and FIG. 3 a side view of a bundle of blades according to a further embodiment.

FIG. 1 discloses a support layer 2 with attached blades 4. The blades are U-shaped tubes 7, having the legs of the tubes 7 in upright position, wherein the openings 8*a*, 8*b* are pointing upwards allowing the entry of raining water and the storage inside the tubes. The stored water 10 can fill the tubes completely.

FIG. 2 shows a further embodiment, wherein the blades 4 and the tubes 7 respectively are combined as a bundle of blades 5. Said bundles are prepared in advance, whereby the tubes in the middle of area 6 are bundled together. The tubes 7 can be pinched off at that position under certain circumstances (not disclosed in FIG. 2), preventing the transport of fluid. This prevents a further entry of water, in particulary when, seen from the connection 6, the tube is filled with air. As a remedy, in order to support the entry of water, when—as shown in FIG. 2—the tubes of the bundle are not pinched off, at least one opening 9 is present, which is located directly above the upper surface of the support layer 2. Air can escape through this opening upon the entry of water through the openings 8*a* and 8*b*. The section of the openings 9 is so small, that water already entered can not flow away.

FIG. 3 depicts a support layer 2 furthermore provided with a water-storing layer 3. A bundle 5 of blades is attached to this layer, thereby positioning the opening 11 near the support layer 2 and/or the water-storing layer 3. With this embodiment the tubes 7 are capable of absorbing fluid from the water-storing layer 3 via said openings 11.

What is claimed is:

1. Artificial lawn comprising:

at least partly hollow plastic blades attached to a support layer, said blades being tubes and being U-shaped.

2. Artificial lawn according to claim 1, wherein said tubes are made from a hydrophilic material.

3. Artificial lawn according to claim 1, wherein said tubes are provided on an interior wall with a hydrophilic layer.

4. Artificial lawn comprising:

at least partly hollow plastic blades attached to a support layer, said blades being tubes provided in a lateral wall with at least one opening.

5. Artificial lawn according to claim 4, further comprising a water-storing layer, said at least one opening is located within at least one of said support layer and said water-storing layer.

6. Artificial lawn according to claim 4, wherein said tubes are made from a hydrophilic material.

7. Artificial lawn according to claim 4, wherein said tubes are provided on an interior wall with a hydrophilic layer.

* * * * *